United States Patent [19]

Hoyer et al.

[11] Patent Number: 4,837,665

[45] Date of Patent: Jun. 6, 1989

[54] MODULAR STAGE LIGHT SYSTEM

[75] Inventors: Bryan Hoyer, San Jose; John Richardson, Los Gatos, both of Calif.

[73] Assignee: Morpheus Lights, Inc., San Jose, Calif.

[21] Appl. No.: 127,890

[22] Filed: Dec. 2, 1987

[51] Int. Cl.[4] ..... F21V 21/14

[52] U.S. Cl. ..... 362/96; 362/233; 362/250

[58] Field of Search ..... 362/250, 233, 285, 418, 362/420, 96, 234, 249; 315/312, 316; 52/6, 28; 272/9, 10, 11, 21, 24

[56] References Cited

U.S. PATENT DOCUMENTS

| | | | |
|---|---|---|---|
| 3,706,914 | 12/1972 | Van Buren | 315/316 |
| 3,845,351 | 10/1974 | Ballmoos et al. | 315/293 |
| 4,388,567 | 5/1983 | Yamazaki et al. | 315/291 |
| 4,392,187 | 7/1983 | Bornhorst | 362/233 |
| 4,511,824 | 4/1985 | Goddard | 315/316 X |
| 4,527,198 | 7/1985 | Callahan | 362/285 X |
| 4,550,276 | 10/1985 | Callahan et al. | 315/316 X |
| 4,602,321 | 7/1986 | Bornhorst | 362/285 X |
| 4,697,227 | 9/1987 | Callahan | 362/233 |
| 4,716,344 | 12/1987 | Newell et al. | 362/420 X |

OTHER PUBLICATIONS

Loney, "Starlight Express", Theater Crafts Magazine, vol. 19, No. 2, 2/85, pp. 18-62.

Syncrolite Systems Inc. Brochure, "Syncrolite The Future is Here . . . ", pub. prior to 1/28/87.

Ness Brochure, "Intelligent Moving Spotlight System", pub. prior to 1/28/87.

Pancan Brochure, "Pancan Moves Light", pub. prior to 1/28/87.

*Primary Examiner*—Ira S. Lazarus

*Assistant Examiner*—Richard R. Cole

*Attorney, Agent, or Firm*—Rosenblum, Parish & Bacigalupi

[57] ABSTRACT

A modular stage light system which features a plurality of trusses, each containing a number of stage lights. The lights are joined to a microprocessor which has an input and an output terminal adapted to be connected to a data bus. A plurality of similar trusses can be mounted on the same data bus. This modular arrangement simplifies transportation, set up and tear down of stage lights associated with theatrical and musical productions.

8 Claims, 4 Drawing Sheets

MODULAR STAGE LIGHT SYSTEM

DESCRIPTION

1. Technical Field

The invention relates to stage lights, and in particular to a system for grouping lights.

2. Background Art

A significant fraction of stage lights in use today are transported from one location to the next in connection with road shows. The staging of a musical or theatrical production on a road location frequently requires the installation of dozens, sometimes hundreds, of stage lights. The mechanical and electrical setup of such lights for a production is a significant enterprise. In the past, this effort has ben characterized by a maze of support structures, power cables and control signal cables. In recent years, stage lights have been adapted with sophisticated control functions which are sometimes controlled by a computer.

In Ballmoos et al. U.S. Pat. No. 3,845,351 there is a description of how a digital computer may be used to control a plurality of stage lights or floodlights. The computer has an associated transmission channel for sending analogue signals to drive various motors associated with each light. A similar concept is found in Bornhorst U.S. Pat. No. 4,392,187 wherein various functions of a stage light, including filters, motors, color wheels, panning and tilting mechanisms and the like are controlled by a digital computer feeding commands to a plurality of lights.

Yamazaki et al. U.S. Pat. No. 4,388,567 teaches that a main control device may feed signals to remote lights each having a terminal control device which recognizes simple codes for adjustment of power to the light.

The prior art recognizes that many sophisticated funcitons of a modern stage light can be remotely controlled by a computer. Such computer control increases the amount of signals which must be communicated to a stage light. Frequently, this means additional wiring or signal channels which must be accommodated in the setup and teardown of a musical or theatrical production stage.

SUMMARY OF THE PRESENT INVENTION

An object of the invention is to simplify the assembly, transportation, setup and teardown of large numbers of stage lights of the type used in a musical or theatrical production.

The above object is achieved by means of a stage light system featuring modular trusses, each of which is modular in the sense of being connectable to an electrical signal bus. A bus architecture allows an indefinite number of trusses to be connected to a remote host computer without increases in electrical cabling between the computer and the trusses. To provided enhanced processing, each truss is equipped with a local group microprocessor for distributed processing of certain commands or operations.

The present invention uses a single local microprocessor for each truss which is physically separated from other trusses. The host controller has an information storage device, such as a disk drive, which is capable of storing a large repertoire of light commands parameters and data which may be updated during a show. The commands include common commands, long used by stage lights, such as zoom, rotate-in-azimuth, rotate-in-elevation, change beamwidth and the like. The repertoire includes such parameters as the geometric location of a truss in relation to a geometric origin, as well as other geometric constants which are needed for computation, such as coefficients of quadratic equations defining motions, such as around circles and ellipses. Lastly, data such as patching possibilities, command sequences and the like are stored.

Inputs are provided at a host controller console so that in addition to stored information, other commands, parameters and data may be entered interacting. Some of the commands, parameters and data are selected, either by a program or manually and one or more local microprocessors are addressed. Each local microprocessor has a computing capability for converting the commands into signals for driving motors. This is in contrast to the prior art where motor driving signals originated at the host computer. A memory associated with each local microprocessor has a storage capability for storing common motions, sequences and patches which may be utilized in a show. These stored routines may be called by the host computer and parameters or data passed from the remote host computer to the local microprocessor for completing a computation. Each microprocessor then drives an associated group of lights with motor signals to carry out a desired function.

An advantage of the invention is that a minimal amount of wiring is required for communicating control signals from the host computer to each truss in that any number of trusses may be connected to the same host computer without significant increases in wiring. Another advantage is that stage lights for productions can be set up, torn down and transported more easily than in the past.

DETAILED DESCRIPTION OF THE PREFERRED EMBODIMENT

Figure 1:
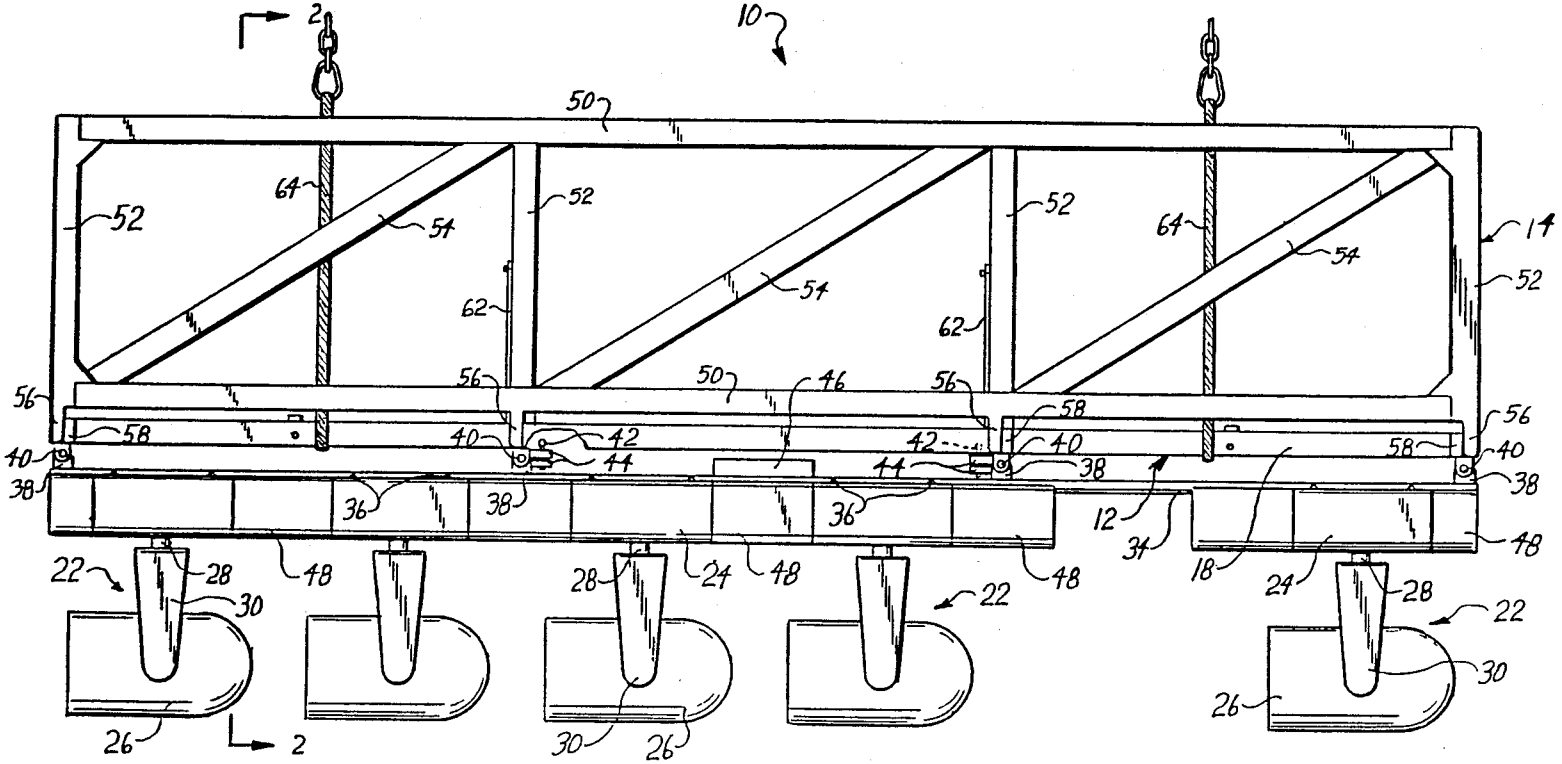
FIG. 1 is a side view of a modular truss unit in accord with the present invention.
Figure 2:
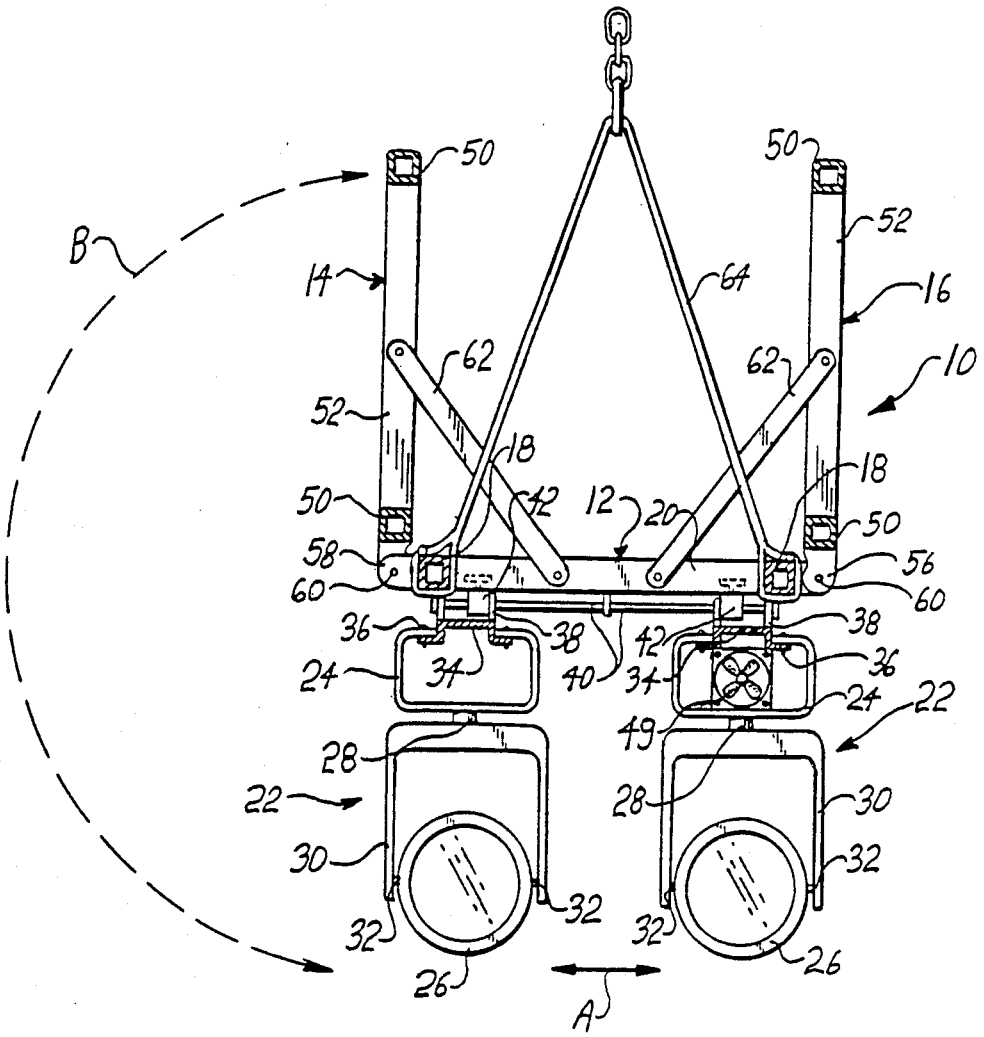
FIG. 2 is a cross sectional view of the truss unit taken along lines 2—2 of FIG. 1.

With reference to FIGS. 1 and 2, a truss unit 10 is shown in an operational configuration. The truss unit 10 includes a frame 12 and opposed lateral (vertical members 14 and 16 pivotally connected to the frame 12. The frame 12 is constructed of a pair of longitudinally extending beams 18 connected together by a plurality of crossbeams 20. The longitudinal beams 18 and crossbeams 20 are made of a material which can support persons walking upon the frame 12.

Lights 22 are suspended from the frame 12. The lights 22 are arranged in a pair of rows under respective beams 18, with lights in adjacent rows being either staggered or in side-by-side relation, as shown in FIGS. 1 and 2. The lights include a control box 24 and a lamp 26. The mechanical and electrical components within the control box 24 are omitted for the purpose of clarity. The lamp 26 is caused to pan by rotation about an axis defined by shaft 28 which turns a forked lamp retainer 30

Figure 3:
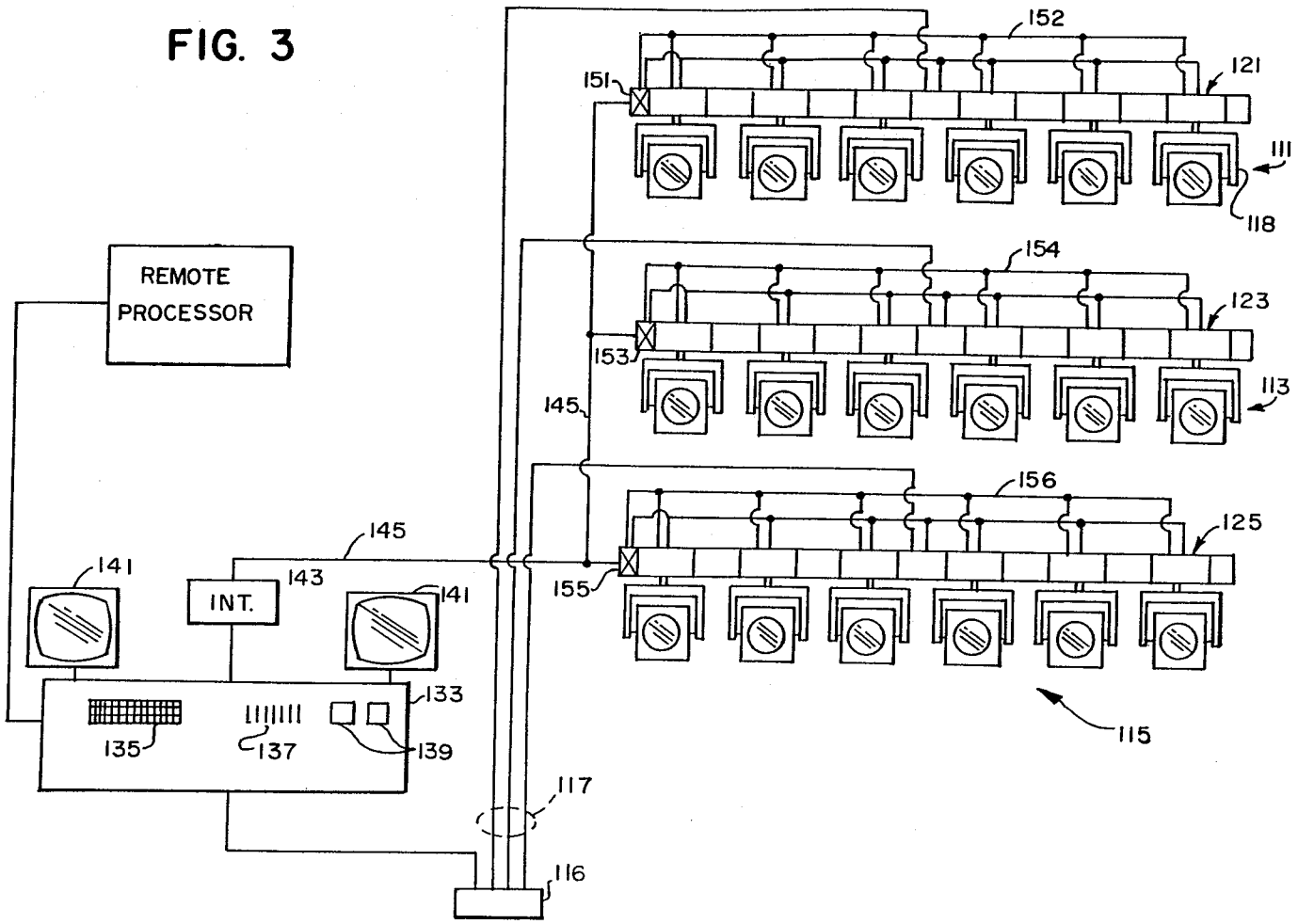
FIG. 3 is a plan view of a modular assembly of stage lights connected to a remote host controller.

(or 118, FIG. 3). Tilting occurs by rotation of the lamp 28 on projections 32 of the forked lamp retainer 30.

The control boxes 24 are attached to a rail 34 and secured in place by retainer pins 36. Control box 24 preferably houses a circuit card having a dedicated processor with memory, input and output circuits. On the one hand, each group microprocessor is connected to each light in its group for transmitting signals and on the other hand, the microprocessor has an input/output connector connected to a data bus 145 as described below. The rail 34 is affixed to a number of brackets 38 having apertures which receive a slide rod 40 connected to the frame 12. Thus, the rails 34 which support the lights 22 are disposed for displacement in a transverse sliding motion on slide rods 40, as indicated by Arrow A of FIG. 2. During operation, the lights 22 must be sufficiently spaced to permit panning and tilting. The rails 34 may be secured in position on slide rods 40 by tightening of T-clamps which press plates 44 together to grasp the slide rods 40, as shown in FIG. 1.

A power connection device 46 is mounted preferably in the center of the frame 12 for the distribution of power to each light 22. A single power line or cable 117 is laced to the power connection device 46, whereafter each light 22 obtains power by connection to the device 46. Spaces along the rail 34 which are not occupied by a control box 24 are covered by a bracket plate 48. Thus, the control boxes and the bracket plates, all of which are open at their longitudinal ends, combine to form an air duct along the length of the truss. In FIG. 1 one light has been omitted to illustrate the rail 34, but typically the air duct extends longitudinally along the entire truss 10. Thus, a single fan 49 may be mounted at an end of the truss 10 to provide air circulation to the components on the control boxes 24, rather than utilizing a separate fan for each control box.

The lateral members 14 and 16 each primarily comprise hollow beams which define elongated sides 50 joined together by perpendicular crossbeams 52 and diagonal crossbeams 54. The lateral members 14 and 16 have ears 56 which are in frictional contact with ears 58 projecting from the frame 12. The ears 56 and 58 of the lateral members and of the frame each have an aperture which receives a hinge pin 60 to define a hinge joint.

The hinging connection of the lateral members 14 and 16 to the frame 12 allows the lateral members to pivot as indicated by Arrow B in FIG. 2. The lateral members 14 and 16 are locked in the U-shaped operation configuration by diagonal braces 62. Both the cross beams 20 of the frame and the lower ends of the diagonal braces 62 have apertures which, when aligned, position the lateral members 14 and 16 at right angles to the frame 12. Pins, not shown, are inserted through the apertures to maintain the truss unit 10 in the operational configuration. The truss unit 10 may then be raised to a desired height by attachment of a chain hoisted cable 64 to the longitudinal beams 18 of the frame. Alternatively, the truss unit 10 may be attached to a ladder lift assembly that is known in the trade to raise the truss unit to various heights.

A plurality of truss units 10 may be mounted end-to-end to form a lighting system. As mentioned above, each truss has a local group microprocessor receiving inputs from and providing outputs to a data bus. The data bus joins any number of trusses to a remote computer. Each truss unit is thus adapted to be electrically linked to a remote computer and may be mechanically linked to an adjacent truss unit. The distant ends of each truss unit include bolt holes which receive bolts sufficiently rigid to hold the truss units together. The truss units are then separated after a performance and stacked. In a stacked arrangement, a truss unit that is positioned above another truss unit will be supported by contact of the legs (not shown) of the upper unit against the longitudinal frame beams 18 of the lower unit. The caster wheels (not shown) 80 of the upper unit will not be in contact with the lower unit.

With reference to FIG. 3, groups of six stage lights 111, 113 and 115 are shown respectively suspended from trusses 121, 123 and 125. Power to the stage lights is supplied from an electrical distribution panel 116 by means of electrical power cables 117. Although individual cables are shown, a power bus could be used.

Each stage light is mounted on a gimbal mounting 118 (or 30). The gimbal mounting permits azimuthal rotation (panning) by means of a motor. The mounting also permits elevational rotation (tilting) by means of another motor. Within the housing of each light are other motors which control beamwidth or focus, such as by means of changes in the shape of a reflector, color changes brought about by rotation of optical filters and changes in beam intensity caused by insertion of other filters. All of the above-mentioned motors are operated independently.

Each truss preferably supports the same number of lights, for example 6 or 12. By use of a fixed number of lights per truss, modularity and interchangeability of trusses is enhanced. There is distributed processing between a remote processor associated with a host controller or processor 131 and local processors 151, 153, 155 etc., each associated with one of the trusses. The host controller 131 has a control console 133 with associated input/output devices, such as keys 135 and switches 137. Keys 135 may be used for programming, or manual direction while switches 137 may be used like potentiometers, i.e. for continuous functions such as dimming and brightening in the manual mode. Additionally, other inputs may come from track balls 139 which can provide dual potentiometer signals for programming or manual commands. Monitors 141 can be used as output device to view programming or to review other information stored in the host processor or the local microprocessors. The host 131 is connected to the local microprocessors by a local area network which features an interface 143, including a bus extender and a data bus 145 which is connected to a local group microprocessor on each of the trusses. The local area network may be any of the known varieties which allows a host computer to communicate with other computers with an established protocol.

A first local microprocessor 151 associated with truss 121 is connected both to the data bus 145 and to an output bus 152 for feeding microprocessor outputs to each of the stage lights on the truss. Similarly, second and third local microprocessors 153 and 155 are connected to groups of stage lights with respective output buses 154 and 156. Each of the output buses 152, 154 and 156 carries motor control signals from a respective microprocessor to stage lights on the same truss.

Figure 4:
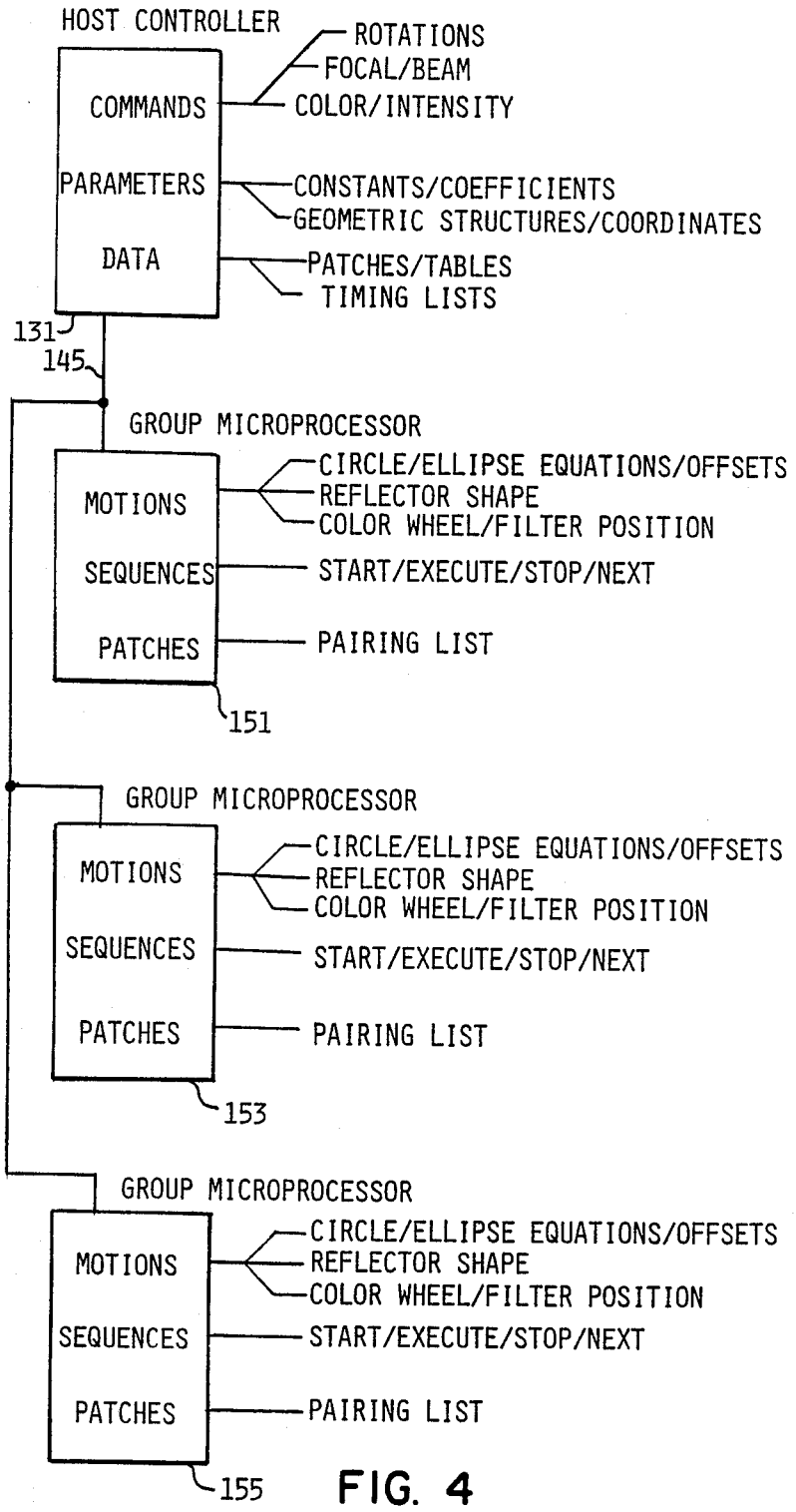
FIG. 4 is a block diagram illustrating divisions of work between a remote host computer and local group processors on board individual trusses in a modular truss arrangement.

With reference to FIGS. 3 and 4, the host controller 131 is configured to handle overall functions and direct specific functions, but not execute specific functions which are more efficiently carried out by the local truss microprocessors. In general, the host handles commands, parameters and data for either individual lights or groups. Commands include functions which may be executed directly such as rotations, beam focus and color and intensity changes. Once these commands are issued, little further processing is needed, except to convert the command signals into motor signals which may be done by the local microprocessor. More complicated commands such as rotations may be called by the host but not computed. This is left for the local microprocessors. In order to execute a more complicated command, constants and coefficients are needed. For example, if a lamp is to execute an elliptical panning motion, parameters representing the size of the ellipse must be sent to the local microprocessor. These parameters are the constants and coefficients of the equation of an ellipse. The microprocessor at a truss has a local memory which stores the equation of an ellipse and is able to use the parameters which are transmitted by the host to compute the proper equation and solve it for X and Y motor motions. Another example is the need to aim stage lights based upon a geometric coordinate system. The host processor contains a map of the stage as well as of the truss locations and is able to provide a transformation to the trusses for taking into account the trusses location when executing commands. The local microprocessor on each truss computes angles based upon geometric coordinants transmitted by the host.

A third example of distributed coprocessor operation is that the host processor may contain data, such as patching lists and tables of light parameters, which can be used in various combinations. For example, some combinations may take advantage of symmetry so that if one stage light is used on the left-hand side of the theater, a counterpart on the right-hand side is similarly used. Often while symmetrical selection is used, the specific symmetrical pairings may be frequently changed. Additionally, colors, intensities and other light qualities may be subject to frequent change according to a plan. Such changes may be set forth in a patch list, with tables of commands for various lights. A timing list may also be prepared for executing various sequences within a show. The host may transmit this to local microprocessors where local pairings are made from a shorter pairing list after which the commands are executed. By using patch tables and lists, the host processor no longer needs to send instructions to individual lights. Rather, instructions are sent to each group and patched lights are determined at the group level for command routing from the local group microprocessors.

The host controller may be an IBM-AT type of processor with a hard disk drive for a small show. For a larger show, the same computer may be connected to a larger mini-computer such as a DEC VAX or the like, having greater computing and storage capability. VAX is a trademark of the Digital Equipment Corporation. The local microprocessors 151,153,155 which are connected to the local area network may have data storage in ROM devices directly mounted on the board. For adequate cooling of the stage lights, the fan-cooled enclosure 24 of FIG. 2 is preferably used to house such boards. Any number of groups of stage lights, each with its own microprocessor may be connected to data bus 145.

What is claimed:

1. A stage lighting system comprising: truss means including an elongated rail supported by said truss means;

a power connection device supported by said truss means; a plurality of light means each having a control box with a modular housing having open ends and being supported by said rail in alignment with open ends of other modular housings, each said control box being electrically connected to said power connection device, lamp means supported by said control box modular housing, and motor means supported by said control box modular housing and responsive to control currents received via an output bus to adjust the operation of said light means; and a fan having a modular housing with open ends and which is supported by said rail in alignment with an open end of another modular housing.

2. A stage lighting system comprising: truss means including an elongated rail supported by said truss means, a power connection device supported by said truss means, a data bus connector supported by said truss means, and a local group microprocessor having a modular housing with open ends and supported by said rail, a memory, a data signal I/O terminal connected to said data bus connector, a power input terminal connected to said power connection device, and an output bus; and a plurality of light means each having a control box with a modular housing having open ends and being supported by said rail in alignment with open ends of other modular housings, each said control box being electrically connected to said output bus and to said power connection device, lamp means supported by said control box modular housing, and motor means supported by said control box modular housing and responsive to control currents received via said output bus to adjust the operation of said light means.

3. The stage lighting system of claim 2 wherein each said group microprocessor memory stores parameters for motor-associated motions, sequences and patches.

4. A stage lighting system as in claim 2 wherein each said control box includes dedicated processor means having a digital-to-analog converter, and wherein each said group microprocessor sends digital control signals via said output bus to selected control boxes which convert said control signals into control currents to adjust the operation of the respective light means.

5. A stage lighting system as in claim 2 wherein said truss means includes:

frame means having longitudinal beams and cross beams, and lateral beams pivotally and lockably connected to said frame means.

6. A stage lighting system as in claim 2 and comprising:

host controller means including a remote pocessor, data bus means connected between said host controller means and said data bus connector, and power distribution means including a power line connected to said power connection device.

7. The stage lighting system of claim 6 wherein said remote processor has a plurality of input devices, each input device affecting a function of one or more of said lighting means, at least some functions of all of said lighting means being controllable by said input devices, and wherein said remote processor has a memory and signal output means and is capable of transmitting commands in response to operations of said input devices and of said memory.

8. The stage lighting system of claim 6 wherein said remote processor has a memory which stores commands, parameters and data recognizable by the connected local microprocessors.

* * * * *